United States Patent [19]

Swiderski et al.

[11] Patent Number: 4,850,065

[45] Date of Patent: Jul. 25, 1989

[54] SOFA BED MECHANISM WITH SAFETY LOCK OUT FEATURE

[75] Inventors: Paul R. Swiderski, Georgetown; Theodore Blevins, Louisville, both of Ky.

[73] Assignee: Leggett & Platt, Incorporated, Carthage, Mo.

[21] Appl. No.: 223,952

[22] Filed: Jul. 25, 1988

[51] Int. Cl.[4] ..... A47C 17/22

[52] U.S. Cl. ..... 5/13; 5/29; 5/36

[58] Field of Search ..... 5/13, 28–36

[56] References Cited

U.S. PATENT DOCUMENTS

| | | | |
|---|---|---|---|
| 3,277,503 | 10/1966 | Steffan | 5/13 X |
| 4,104,745 | 8/1978 | Pacitti | 5/13 |
| 4,509,216 | 4/1985 | Blevins et al. | 5/13 |

FOREIGN PATENT DOCUMENTS

| | | | |
|---|---|---|---|
| 1273398 | 5/1972 | United Kingdom | 5/13 |

*Primary Examiner*—Gary L. Smith
*Assistant Examiner*—Michael F. Trettel
*Attorney, Agent, or Firm*—Harness, Dickey & Pierce

[57] ABSTRACT

A sofa bed mechanism for use on a foldable bed frame having a head section, an intermediate section, and a foot section, comprises a rear linkage assembly on a support member operable to control movement of the bed frame in between extended and folded sofa positions, a pivotal leg extending from each of the foot and intermediate sections, a front linkage assembly connected to the legs and to the rear linkage assembly for moving the legs into downwardly extending support positions in response to movement of the bed frame to the horizontal position and means extending between the front and rear linkages which maintains downwardly directed forces on the legs to prevent the folding of the bed frame from the horizontal position toward the folded sofa position in response to a downwardly directed load on the head section.

5 Claims, 4 Drawing Sheets

SOFA BED MECHANISM WITH SAFETY LOCK OUT FEATURE

BACKGROUND AND SUMMARY OF THE INVENTION

This invention relates to sofa bed mechanisms and more particular a sofa bed mechanism mounted within a sofa frame for movement between a horizontal bed position and a folded sofa position.

U.S. Pat. No. 4,509,216, assigned to the assignee of the present invention, describes such a sofa bed mechanism. Among the objects of conventional sofa bed mechanisms is to provide firm, stable support for users in the bed position. Unfortunately, conventional sofa bed mechanisms tend to fold up when a downward force is applied to the extended folding mechanism at a position at the head section of the sofa bed mechanism. This can be quite disconcerting to the user of the sofa bed, and usually occurs when the sofa bed occupant is in a sitting-like position near the head of the bed.

It is therefore an object of the present invention therefore to provide an improved sofa bed mechanism with a locking feature that provides a stable sofa bed platform when a load is applied to the head section.

It is another object of the invention to provide a sofa bed mechanism which transmits a portion of the downward force exerted on the head section to the foot section to maintain the sofa bed mechanism in the horizontal bed position.

The present invention provides a sofa bed mechanism with a foldable bed frame which includes in succession a head section, an intermediate section and a foot section, each joined at their ends and movable between a horizontal bed position and a folded sofa position. The foldable bed frame is attached to a support member. A folding mechanism is attached between the foldable bed frame and the support member and includes a rear linkage assembly on the support member which is operable to control the movement of the bed frame between the bed and sofa positions.

The folding mechanism further includes a pivotal leg extending from each of the foot and intermediate sections, a front linkage assembly connected to the legs and to the rear linkage assembly for moving the legs into a downwardly extending support position in response to movement of the bed frame into the horizontal bed position, and means extending between the front and rear linkages which maintains a downward directed force on the legs to prevent the folding of the bed frame from the horizontal position to the folded sofa position in response to a downward load applied to the head section.

The rear linkage of the folding mechanism includes an elongated suspension arm which has one end pivotally connected to the head section, an elongated connecting link connected to one end of the suspension arm and a first and second parallel arm each having one end pivotally connected to the support member. The other end of the first parallel arm is pivotally connected to one end of the suspension arm. The other end of the second parallel arm is pivotally connected to the other end of the connecting link.

A cross link member is connected to the other end of the first parallel arm and the second parallel arm. The cross link maintains the parallel arms in parallel relation as the folding mechanism is moved between the horizontal bed position and the folded sofa position.

An elongated lock out bar extends between the front linkage and the rear linkage assemblies. The lockout bar has one end pivotally attached to the suspension arm attached to the head section and has its other end pivotally attached to a leg locking strap in the front linkage assembly which is pivotally attached between the leg pivoted from the foot section and the intermediate section whereby the lock out bar connected between the suspension arm and the lock out strap exerts a downward force on the strap when a downward force is exerted on the head section thereby preventing the suspension arm from rotating counterclockwise to fold the bed frame when downward force is exerted on the head section.

The front linkage assembly of the folding mechanism according to the present invention further comprises a front leg brace member which is connected between the leg pivoted from the foot section and the locking strap. This brace member is pivotally connected to the leg at a point below the leg's pivot point such that a downward force on the locking strap placed thereon by the lock out bar pulls the leg downward to maintain the bed frame in a horizontal position.

Thus if a person were to sit on the head section or otherwise exerts a downward load on the head section on the folding bed frame when it is in the horizontal bed position, a portion of the downward force is transmitted to the force legs via the suspension arm, the lock out bar, and the leg locking strap to lock the folding mechanism in the horizontal position. This makes the folding sofa bed mechanism safer to use and more stable under all load conditions.

Further objects, features and advantages of this invention will become apparent from a consideration of the appended claims, the following description and the accompanying drawing.

DETAILED DESCRIPTION OF THE INVENTION

Figure 1:
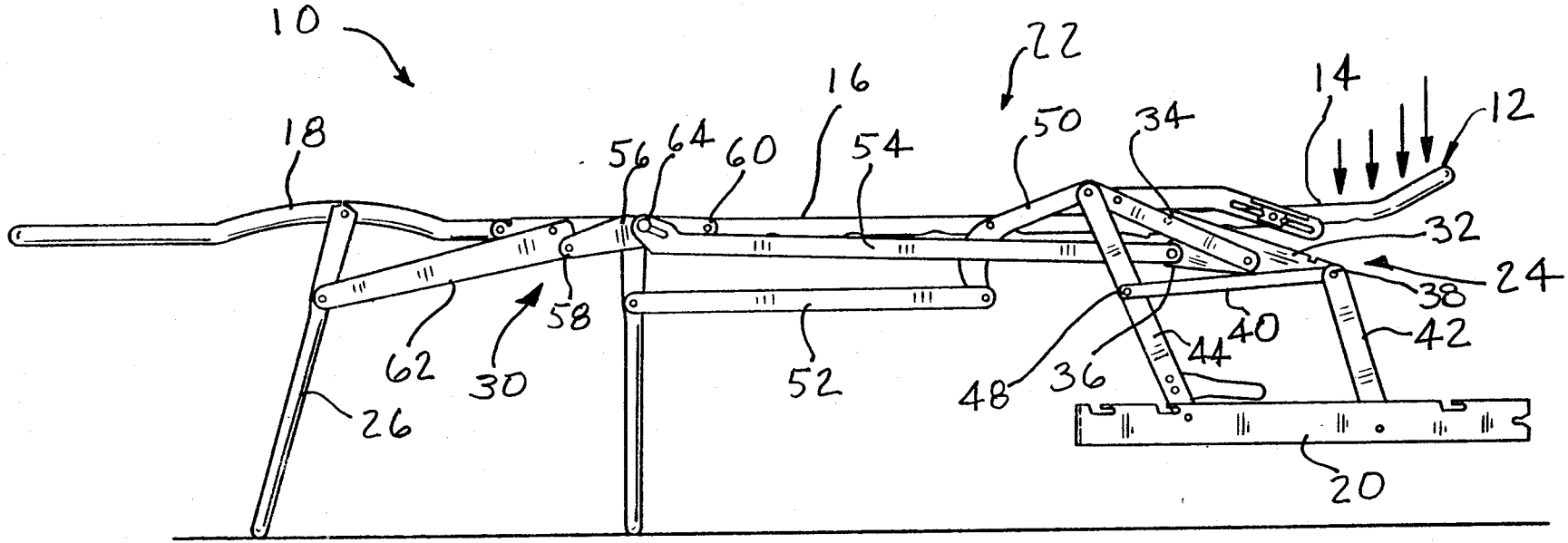
FIG. 1 is a side view of the folding mechanism according to the present invention shown in the horizontal bed frame position.

The sofa bed mechanism according to the present invention, indicated generally at 10, is illustrated in FIGS. 1-4 in various stages of folding. The drawing shows the mechanism linkages and bed frame members on only one side of the sofa bed. An identical symmetrical folding mechanism, although not shown, is positioned on the opposite side of the sofa bed. One side is illustrated, described and is representative of the opposite side mechanism to minimize duplication in this description.

In FIG. 1, the mechanism 10 is shown in the horizontal bed position and includes a foldable bed frame 12 which has a head section 14, an intermediate section 16 and a foot section 18. The foot section 18 is pivotally joined to one end of the intermediate section 16 which is in turn pivotally joined at the other end to the head section 14.

Foldable bed frame 12 is supported from a support bracket 20 on sofa frame 21 by a folding mechanism 22. Folding mechanism 22 includes a rear linkage assembly 24 attached to support member 20 and operable to control movement of foldable bed frame 12 between the bed and sofa position. Pivotal legs 26 and 28 extend downwardly from the foot section and the intermediate section respectively to support these sections when the movable bed frame is in the horizontal bed position. A front linkage assembly 30 connected to legs 26 and 28 and to rear linkage assembly 24 moves the legs into downwardly extending support positions in response to movement of the foldable bed frame 12 to the horizontal bed position.

Rear linkage assembly 24 includes an elongated generally acute triangularly shaped suspension arm 32 having a base end with corners 34 and 36 and an apex end 38. Suspension arm 32 is pivotally connected at the base end corner 34 to the pivotal joint between intermediate sections 16 and head section 14. An elongated connecting link 40 is pivotally connected at one end to the suspension arm 32 at a point spaced between the base end and the apex end 38. A first parallel arm 42 and a second parallel arm 44 each having one end pivotally connected to support bracket 20. The other end of first parallel arm 42 is pivotally connected to the apex end 38 of the suspension arm 42. The other end of second parallel arm 44 is pivotally connected to the other end of connecting link 40.

First and second parallel arms 42 and 44 are maintained in parallel relation by a cross link member 46. One end of cross link member 46 is pivotally connected to the other end of first parallel arm 42 to which the apex end 38 of suspension arm 32 is also attached. The other end of cross link member 46 is pivotally connected to second parallel arm 44 at a point 48 spaced between the ends of second parallel arm 44.

At the other end of second parallel arm 44 to which is attached the other end of connecting link 40, is also connected one end of a curved connecting arm 40. The other end of curved connecting arm 50 is pivotally connected to strap link 52 which is in turn pivotally connected to rear leg 28. Curved connecting arm 50 is also pivotally connected at its middle to intermediate section 16. Thus when curve connecting arm 50 pivots counterclockwise about the middle connection point, leg 28 is pulled upward toward intermediate section 16.

An elongated lockout bar 54 is connected between rear linkage assembly 24 and front linkage assembly 30. Lock out bar 54 is pivotally connected at one end to base end corner 36 of suspension arm 32. The opposite end of elongated lock out bar 54 has a slot therethrough and is pivotally connected through the slot to a front leg locking strap 56 in front linkage assembly 30.

The front leg locking strap 56 is a generally flat obtuse triangularly shaped member having opposing base ends 58 and 60. Base end 58 of front end locking strap 56 is connected to one end of front leg brace 62. The opposite end of leg brace 62 is in turn pivotally connected to the front leg 26 at a point spaced from the end of the front leg 26 that is pivotally connected to foot section 18. The base end 60 of the front leg locking strap 56 is pivotally connected to intermediate section 16.

Front leg brace 62 is also pivotally connected to intermediate section 16 at a point spaced from the pivotal connection to base end 58 of locking strap 56 at the same end of front leg brace 62. Thus, a counterclockwise rotational force applied to front leg locking strap 56 about the pivotal connection at base end 60 will cause a counterclockwise rotational force to be applied to front leg brace 62 about the connection of front leg brace 62 to intermediate section 16. This causes a downward force to be applied to front leg 26 to maintain the bed frame 12 in a horizontal position which prevents the upward folding of the foot section 18.

As can be seen in FIG. 1, a downward force applied in the direction of the arrows on the head section 14 causes a downward force to be applied to the base end of suspension arm 32. The suspension arm 32 therefore tries to rotate counterclockwise about apex end 38. This places lockout bar 54 in tension which in turn causes lockout bar 54 to pull downward against the pivotal connection to front leg locking strap 56. Locking strap 56 tries to rotate counterclockwise about end 60. The counterclockwise rotational force applied to strip 56 about the pivotal connection at end 60 causes front leg 26 to be held downward by the connection through front leg brace 62 thus causing foot section 18 to remain locked in the horizontal position.

Figure 2:
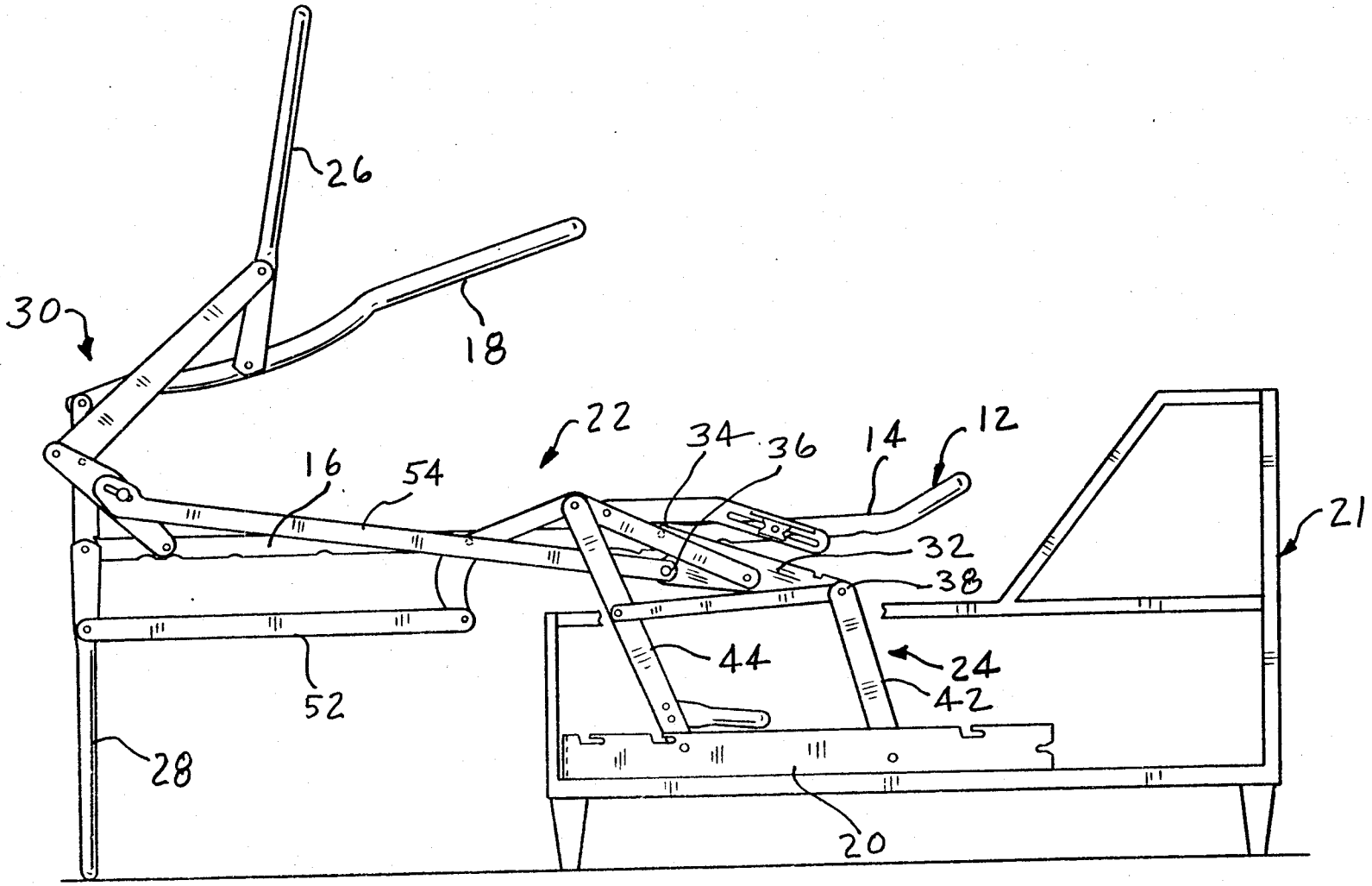
FIG. 2 is a side view of the folding mechanism shown in FIG. 1 with the folding mechanism in the partially folded position.
Figure 3:
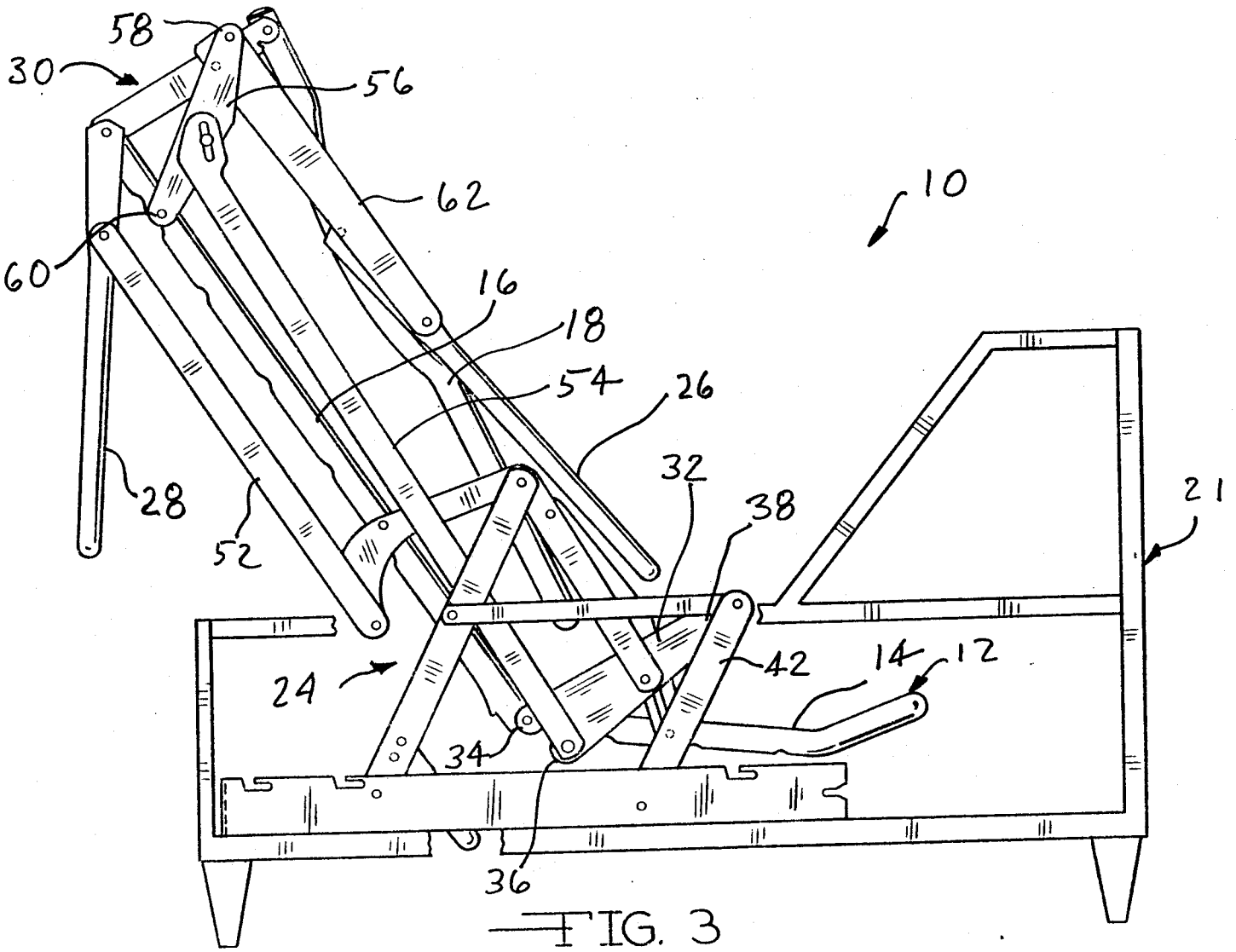
FIG. 3 is a side view of the folding mechanism according to the present invention in a further folded position.
Figure 4:
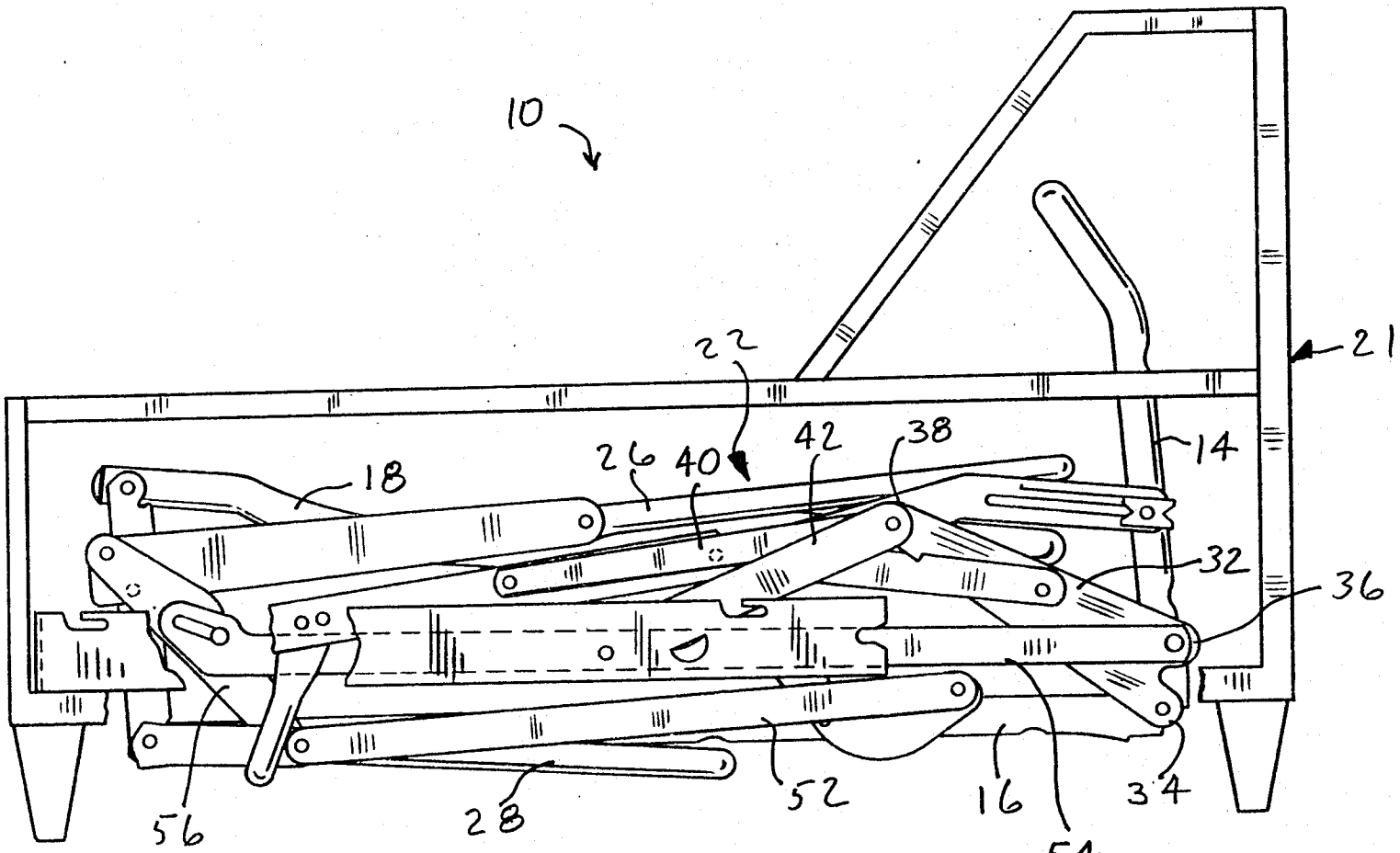
FIG. 4 is a side view of the folding mechanism according to the present invention in the fully folded sofa position showing the mechanism of the invention fully within the sofa frame.

As shown in FIGS. 2, 3, and 4, in order to fold bed frame 12 into sofa frame 21, foot section 18 must be raised which in turn releases the tension on lockout bar 54 and causes a counterclockwise rotation of suspension arm 32. Foot section 18 folds counterclockwise upward and over intermediate section 16 and rear leg 28 rotates counterclockwise underneath intermediate section 16 to achieve the folded bed frame configuration as shown in FIG. 4.

In contrast, when bed frame 12 is in the horizontal bed position shown in FIG. 1, counterclockwise rotation of suspension arm 32 is prevented by the tension force applied by lockout bar 54 connected between front leg locking strap 56 and suspension arm 32. This tension on lockout bar 54 in turn transmits a downward force to front leg 26 through front linkage 30 as above described. The folding mechanism 22 thus provides a positive means for preventing the folding of bed frame 12 unless foot section 18 is lifted upward to begin the folding sequence.

The sofa bed folding mechanism of the invention has been described above in an illustrative manner and it is to be understood that the terminology that has been used is intended to be in the nature of words of description rather than of limitation. Obviously many modifications and variations of the present invention are possible in light of the above teachings. For example, the linkage members described above may be of different shape than as specifically shown in FIGS. 1–4. It is therefore to be understood that within the scope of the appended claims, the invention may be practiced otherwise than as specifically described.

What is claimed is:

1. In a sofa bed having a foldable bed frame including in succession a head section, an intermediate section and a foot section, said sections being pivotally joined at their ends and movable between a substantially horizontal bed position and a folded sofa position, and a support member on which said bed frame is supported, a folding mechanism comprising:

a rear linkage assembly on said support member operable to control movement of said bed frame between said bed and sofa positions, said rear linkage assembly having an elongated suspension arm having one end pivotally connected to said head section, an elongated connecting link having one end pivotally connected to said suspension arm, and a first and a second parallel arm each having one end pivotally connected to said support member, the other end of the first parallel arm pivotally connected to one end of said suspension arm, the other end of said second parallel arm pivotally connected to the other end of said connecting link;

a pivotal leg extending from each of said foot and intermediate sections;

a front linkage assembly connected to said legs, said foot and intermediate sections, and to said rear linkage assembly for moving said legs into downwardly extending support positions in response to movement of said bed frame to the horizontal bed position; and means extending between said front and rear linkages maintaining a downwardly directed force on said leg extending from said foot section to prevent the folding of said bed frame from the horizontal bed position toward the folded sofa position in response to a downward load on said head section.

2. The mechanism according to claim 1 wherein said one end of said suspension arm is connected to said head section at the pivotal joint between said head and intermediate sections.

3. The mechanism according to claim 2 wherein a cross link member is connected between said other end of said first parallel arm and said second parallel arm to maintain said parallel arms in parallel relation.

4. The mechanism according to claim 1 wherein said means for preventing the folding of said bed frame comprises:

an elongated lockout bar having one end pivotally attached to said end of said suspension arm having said head section connected thereto;

a leg locking strap having one end pivotally connected to said leg pivoted from said foot section and the other end of said strap being pivotally connected to said intermediate section; and the other end of said lockout bar being pivotally connected to said strap whereby said lockout bar connected between said suspension arm and said locking strap exerts a downward force on said strap thereby locking said leg down preventing said suspension arm from rotating counterclockwise to fold said frame when a downward load is exerted at said head section.

5. The mechanism according to claim 4 wherein said means for preventing the folding of said bed frame further comprises a front leg brace member connected between said leg pivoted from said foot section and said locking strap, said brace member having one end attached to said leg pivoted from said foot section at a point on said leg spaced from said pivot point whereby said downward force on said strap by said lockout bar pulls said leg downward maintaining said frame in a horizontal position.

* * * * *